US011482186B2

(12) United States Patent
Zhou

(10) Patent No.: US 11,482,186 B2
(45) Date of Patent: Oct. 25, 2022

(54) DRIVING METHOD FOR DISPLAY PANEL AND DRIVER CIRCUIT FOR DISPLAY PANEL

(71) Applicants: HKC CORPORATION LIMITED, Shenzhen (CN); CHONGQING HKC OPTOELECTRONICS TECHNOLOGY CO., LTD., Chongqing (CN)

(72) Inventor: Mancheng Zhou, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/297,443

(22) PCT Filed: Jun. 9, 2020

(86) PCT No.: PCT/CN2020/095089
§ 371 (c)(1),
(2) Date: May 26, 2021

(87) PCT Pub. No.: WO2020/248970
PCT Pub. Date: Dec. 17, 2020

(65) Prior Publication Data

US 2021/0398502 A1 Dec. 23, 2021

(30) Foreign Application Priority Data

Jun. 11, 2019 (CN) ..... 201910500017.6

(51) Int. Cl.
*G09G 3/36* (2006.01)

(52) U.S. Cl.
CPC ... *G09G 3/3696* (2013.01); *G09G 2320/0276* (2013.01)

(58) Field of Classification Search
CPC ..... G09G 3/36; G09G 3/3611; G09G 3/3648; G09G 3/3655; G09G 3/3685;
(Continued)

(56) References Cited

U.S. PATENT DOCUMENTS

2003/0043127 A1* 3/2003 Satoh ..... G09G 3/3216 345/204
2009/0109158 A1* 4/2009 Shirai ..... G09G 3/3688 345/94
(Continued)

FOREIGN PATENT DOCUMENTS

CN 102290032 A 12/2011
CN 109473078 A 3/2019
(Continued)

OTHER PUBLICATIONS

Jun Li, the ISA written comments, dated Sep. 2020, CN.
Jun Li, the International Search Report, dated Sep. 2020, CN.

*Primary Examiner* — Keith L Crawley

(57) ABSTRACT

The application discloses a driving method and a driver circuit for a display panel, where the driving method includes the following steps: starting a source electrode driver circuit, outputting OV voltage, and simultaneously enabling a common line to output 0 V voltage or be disconnected; outputting, a preset initial voltage by the source electrode driver circuit, and simultaneously enabling the common line to output the identical initial voltage; after starting the source electrode driver circuit, transmitting a gray-scale voltage to the display panel; meanwhile, control-
(Continued)

ling a gamma circuit of the display panel to output a preset common voltage to the common line through a common voltage line.

18 Claims, 5 Drawing Sheets

(58) Field of Classification Search
CPC ..... G09G 3/3688; G09G 3/3696; G09G 2300/0421; G09G 2300/0426; G09G 2300/043; G09G 2300/0876; G09G 2310/0245; G09G 2310/0248; G09G 2310/0251; G09G 2310/061; G09G 2310/063; G09G 2310/065; G09G 2320/0247; G09G 2320/0276; G09G 2330/02; G09G 2330/022; G09G 2330/026
See application file for complete search history.

(56) References Cited

U.S. PATENT DOCUMENTS

| | | | | |
|---|---|---|---|---|
| 2011/0310135 | A1* | 12/2011 | Feng | G09G 3/3648 345/90 |
| 2012/0098817 | A1 | 4/2012 | Cheng et al. | |
| 2016/0365056 | A1* | 12/2016 | Sun | G09G 3/3688 |
| 2017/0178587 | A1* | 6/2017 | Jin | G09G 3/3696 |
| 2021/0110779 | A1* | 4/2021 | Wang | G09G 3/3648 |
| 2021/0118400 | A1* | 4/2021 | He | G09G 3/2092 |
| 2021/0225319 | A1* | 7/2021 | Han | G09G 3/3655 |

FOREIGN PATENT DOCUMENTS

| | | | |
|---|---|---|---|
| CN | 109493781 | A | 3/2019 |
| CN | 110444174 | A | 11/2019 |

* cited by examiner

DRIVING METHOD FOR DISPLAY PANEL AND DRIVER CIRCUIT FOR DISPLAY PANEL

CROSS REFERENCE OF RELATED APPLICATIONS

The present application claims the priority to the Chinese Patent Application CN201910500017.6, filed to National Intellectual Property Administration, PRC on Jun. 11, 2019 and entitled "DRIVING METHOD AND DRIVER CIRCUIT FOR DISPLAY PANEL", which is incorporated herein by reference in its entirety.

TECHNICAL FIELD

The present application relates to the technical field of display, especially a driving method and a driver circuit of a display panel.

BACKGROUND

The statements herein merely provide background information related to the present application and do not necessarily constitute the conventional art.

Liquid Crystal Display (LCD), particularly Thin Film Transistor-Liquid Crystal Display (TFT-LCD), are increasingly widely used due to their advantages of being light, thin, and convenient to carry, but the existing LCDs may flicker during use, which affects the display quality thereof.

After the TFT-LCD is powered on, the common voltage can reach the reference voltage in a short time, the source electrode driving voltage value is 0 V because the source electrode driver needs to be reset, and at the moment, if the gate electrode driver is turned on, there will be a voltage difference between the two ends of the liquid crystal, which leads to flash problems and affects people's viewing experience.

SUMMARY

The purpose of the present application is to provide a driving method and a driver circuit for a display panel for reducing flashes during startup.

The present application provides a driving method for a display panel, which includes the following steps:

starting the display panel;

starting a source electrode driver circuit of the display panel, outputting OV voltage, and simultaneously enabling a common line of the display panel to output 0 V voltage or be disconnected;

outputting a preset initial voltage by the source electrode driver circuit of the display panel, and simultaneously enabling the common line of the display panel to output the identical initial voltage;

after starting the source electrode driver circuit of the display panel, transmitting a gray-scale voltage to the display panel; meanwhile, controlling a gamma circuit of the display panel to output a preset common voltage to the common line through a common voltage line.

The present application also discloses a driver circuit for a display panel, which includes a source electrode driver circuit configured to supply driving voltage for the display panel, a gamma circuit configured to supply common voltage for the display panel, a first switch, a second switch, a third switch, a common voltage line through which the gamma circuit outputs a preset common voltage to the common line, and a detection circuit configured to detect the source electrode driver circuit and be in control connection with the second switch and the third switch; where the output terminal of the source electrode driver circuit is in control connection with the control terminal of the first switch; the output terminal of the second switch is connected to the input terminal of the first switch; the output terminal of the gamma circuit is connected to the input terminal of the second switch and the input terminal of the third switch; the detection circuit is in control connection with the control terminals of the second switch and the third switch, respectively; the output terminal of the first switch and the output terminal of the third switch are respectively connected to the common line of the display panel; the source electrode driver circuit of the display panel is started, OV voltage is output, the first switch is kept off, the detection circuit is initialized to control the second switch and the third switch to be kept on when the detection circuit is started, and the gamma circuit outputs OV voltage to the common line through the common voltage line; when the source electrode driver circuit is started and outputs a preset initial voltage, the detection circuit turns on the first switch, keeps the second switch on, meanwhile keeps the third switch off, and outputs the identical voltage as the initial voltage to the common line; and when the source electrode driver circuit finishes starting and outputs a gray-scale voltage, the detection circuit controls the second switch to be kept off, meanwhile keeps the third switch on, and the gamma circuit outputs a preset common voltage to the common line.

The present application also discloses a driver circuit for a display panel, which includes a source electrode driver circuit configured to supply driving voltage for the display panel, a gamma circuit configured to supply common voltage for the display panel, a first switch, a second switch, a third switch, a common voltage line through which the gamma circuit outputs a preset common voltage to the common line, and a detection circuit configured to detect the source electrode driver circuit and be in control connection with the second switch and the third switch; where the output terminal of the source electrode driver circuit is in control connection with the control terminal of the first switch and the input terminal of the second switch; the output terminal of the second switch is connected to the input terminal of the first switch; the input terminal of the third switch is connected to the output terminal of the gamma circuit; the detection circuit is in control connection with the control terminals of the second switch and the third switch, respectively; the output terminal of the first switch and the output terminal of the third switch are respectively connected to the common line of the display panel; the detection circuit is initialized to control the third switch to be kept on when the detection circuit is started, and the gamma circuit outputs OV voltage to the common line through the common voltage line; when the source electrode driver circuit is started and outputs a preset initial voltage, the detection circuit keeps the second switch on, meanwhile keeps the third switch off, and turns on the initial voltage to the common line; and when the source electrode driver circuit finishes starting and outputs a gray-scale voltage, the detection circuit controls the second switch to be kept off, meanwhile, keeps the third switch on.

After the display panel is started, the source electrode driver circuit is started and can output in three stages: 0 V, a preset initial voltage and a gray-scale voltage after the startup. The present application outputs the identical voltage as the output of the source electrode driver circuit to a common line in the first two stages, controls the common voltage and the source electrode driving voltage are kept consistent when the display panel is started, and enables the voltage difference between liquid crystals of the front panel to tend to be zero prior to picture data input, which avoids flash problems during startup, improves the product quality, and thus improving people's visual experience.

BRIEF DESCRIPTION OF DRAWINGS

The accompanying drawings, which are included to provide a further understanding of embodiments of the present application and constitute a part of the specification, illustrate embodiments of the application and, together with the text description, explain the principles of the application. Obviously, the drawings in the following description are merely some embodiments of the present application, and those skilled in the art can obtain other drawings according to the drawings without any inventive labor. In the drawings.

DETAILED DESCRIPTION OF EMBODIMENTS

The specific structural and functional details disclosed herein are merely representative and are illustrative of the exemplary embodiments of the present application. However, the present application may be embodied in many optional forms and should not be construed as being limited only to the embodiments set forth herein.

In the description of the present application, it should be understood that, the terms "center", "transverse", "up", "down", "left", "right", "vertical", "horizontal", "top", "bottom", "inner", "outer" and the like for indicating an orientation or positional relationship are based on the orientation or positional relationship shown in the accompanying drawings, and are intended solely to facilitate description and simplification of the description, and are not intended to indicate or imply that the device or element referred to must have a specific orientation, be constructed and operated in a specific orientation, and thus is not to be construed as limiting the present application. Further, the terms "first" and "second" are only for the purpose of description and cannot be construed to indicate relative importance or imply an indication of the number of technical features indicated. Therefore, a feature defined as "first" and "second" may explicitly or implicitly include one stage or more stages of the features. In the description of the present application, "multiple stages" means two stages or more stages unless otherwise noted. In addition, the term "including" and any variations thereof are intended to cover non-exclusive inclusion.

In the description of the present application, it should be noted that, unless expressly specified and defined otherwise, the terms "mount", "attach" and "connect" are to be understood broadly, for example, it can be a fixed connection, a detachable connection, or an integral connection; it can be an either mechanical connection or an electrical connection; it can be a direct connection or an indirect connection through an intermediate medium, and can be an internal connection between two-stage elements. For those skilled in the art, the specific meaning of the above terms in this application can be understood according to the specific circumstances.

The terms used herein are merely intended to describe specific embodiments and are not intended to limit the exemplary embodiments. Unless clearly indicated by the context otherwise, the singular forms "a" or "an" are intended to include the plural. It should also be understood that the terms "include" and/or "comprise" as used herein specify the presence of the features, integers, steps, operations, units and/or components set forth without excluding the presence or addition of one or more other features, integers, steps, operations, units, components and/or combinations thereof.

The present application will now be further described by reference to the accompanying drawings and optional embodiments.

Figure 1:
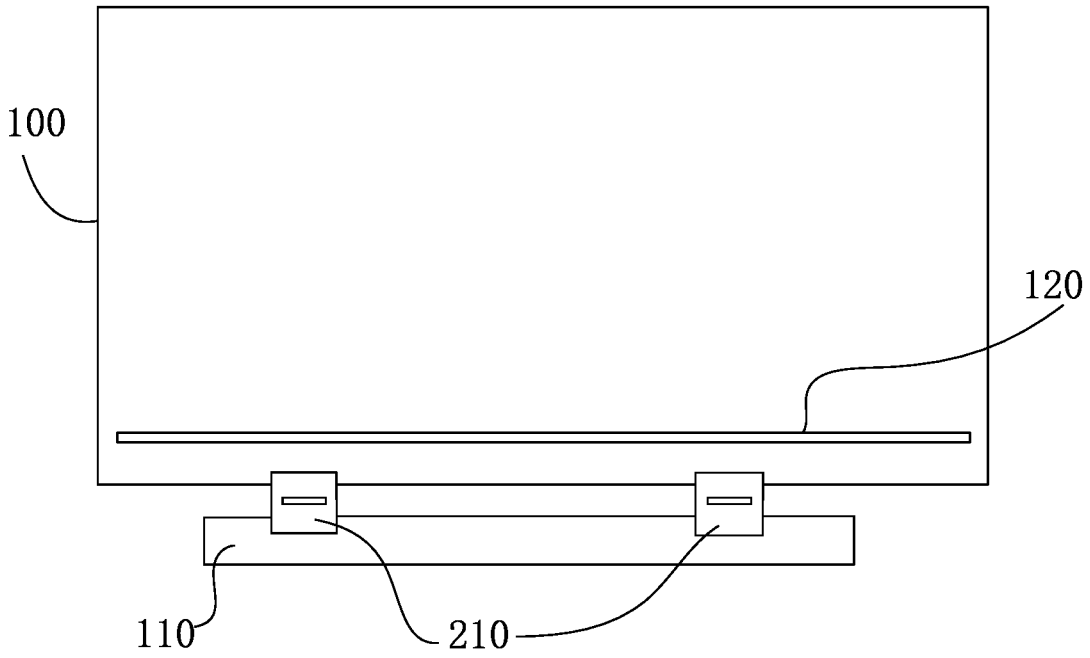
FIG. 1 is a schematic diagram of a display panel with a flash problem.

Referring to FIG. 1, when the display panel 100 is started, the common voltage can reach the reference voltage in a short time, the voltage value of the source electrode driver circuit 210 is 0 V because the source electrode driver circuit 210 needs to be reset, and at the moment, if the gate electrode driver is turned on, there will be a voltage difference between the two ends of the liquid crystal, which leads to flash problems 120.

Figure 2:
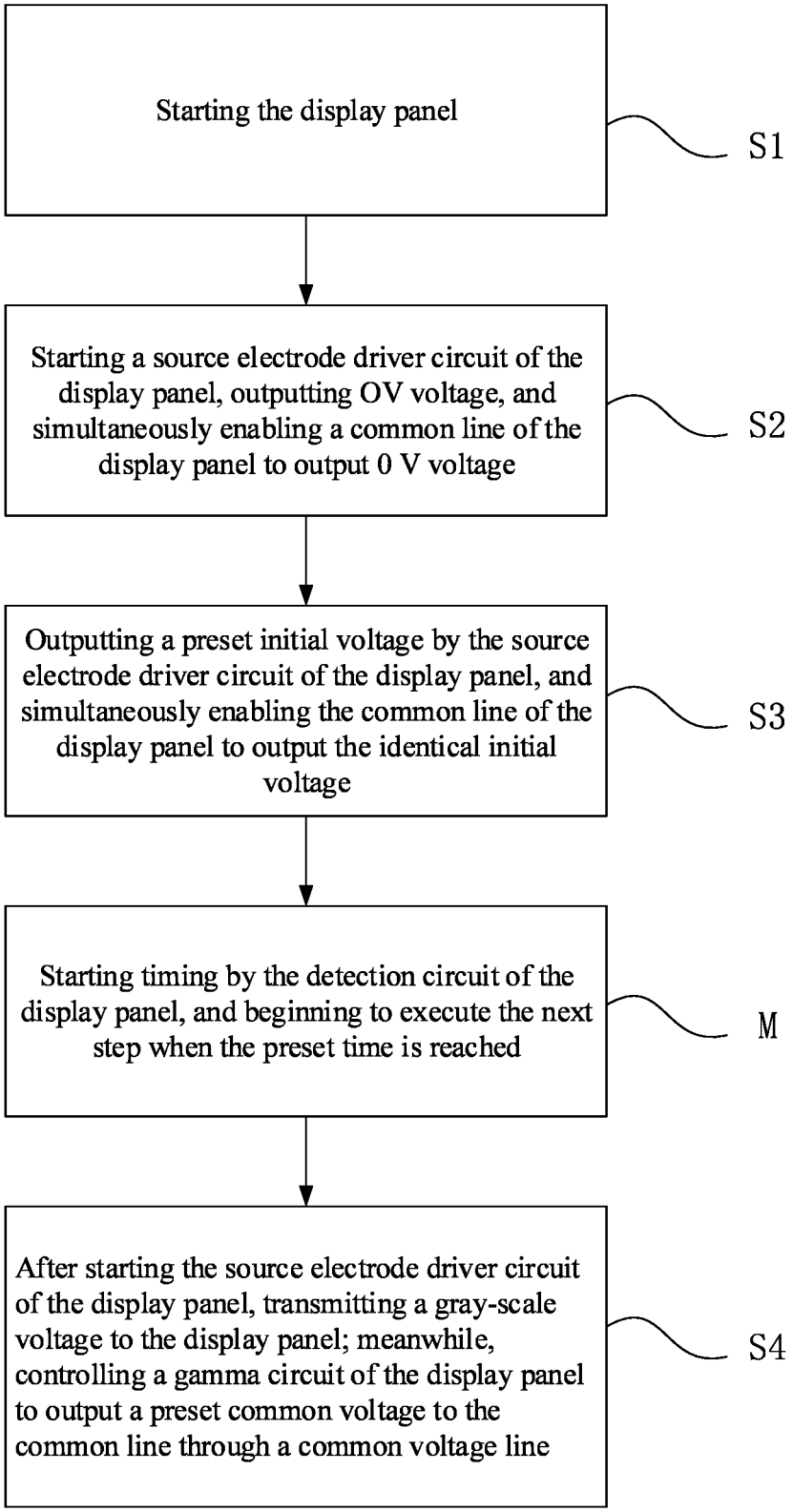
FIG. 2 is a schematic flowchart of a driving method for a display panel according to an embodiment of the present application.

Referring to FIG. 2, the present application discloses a driving method for a display panel, which includes the following steps:

S1: starting the display panel;

S2: stage one: starting a source electrode driver circuit of the display panel, outputting OV voltage, and simultaneously enabling a common line of the display panel to output 0 V voltage or be disconnected;

S3: stage two: outputting a preset initial voltage by the source electrode driver circuit of the display panel, and simultaneously enabling the common line of the display panel to output the identical initial voltage;

S4: stage of normal display: after starting the source electrode driver circuit of the display panel, transmitting a gray-scale voltage to the display panel; meanwhile, controlling a gamma circuit of the display panel to output a preset common voltage to the common line through a common voltage line 270.

When the display panel is started, the source electrode driver circuit of the display panel is started, this is stage one of starting the gate electrode driver circuit, where the output voltage is 0 V because the source electrode driver circuit needs to be reset, and the voltage of 0 V is transmitted to the common line through the gamma circuit at the moment, so that the voltages at two ends of the liquid crystal in the panel are consistent; the output voltage of the source electrode driver circuit continuously rises and reaches a preset initial voltage (for example, the initial voltage after the startup is preset to be 7 V), this is stage two of starting the gate electrode driver circuit, where the identical initial voltage is output to the common line. After the source driver circuit is started, the timing controller (referring to FIG. 3) outputs the gray-scale voltage to the source electrode driver circuit, and finally transmits the gray-scale voltage to the display panel through the source electrode driver circuit, and meanwhile, the gamma circuit outputs a preset common voltage (such as 0 V, 1 V or even 7 V and the like) to the common line to control the display panel to normally display. Corresponding voltages are respectively connected to the common line in stage one and stage two, so that the voltage difference between two ends of the liquid crystal is ensured to be close to zero, which avoids flash problems during startup.

Specifically, in stage one: controlling a first switch connected to the first common voltage line to be kept off and turning off the first common voltage line; controlling a third switch connected to a second common voltage line to be kept on, and turning on the second common voltage line, to enable the common line of the display panel to output 0 V voltage; or, turning off the first common voltage line and the second common voltage line at the same time, and disconnecting the common voltage line from the common line of the display panel, to make the voltage on the common line also 0 V, which is consistent with the output voltage of the source electrode driver circuit;

in stage two: controlling a first switch and a second switch connected to a first common voltage line to be kept on, and turning on the first common voltage line; controlling a third switch connected to a second common voltage line to be kept off, and turning off the second common voltage line, to enable a common line of the display panel to output the identical initial voltage;

in stage of normal display: controlling the second switch connected to the first common voltage line to be kept off, and turning off the first common voltage line; controlling a third switch connected to the second common voltage line to keep the second common voltage line turned on, and outputting a preset common voltage to the common line of the display panel.

The common voltage input to the common line is controlled by the first common voltage line and the second common voltage line respectively, the first common line and the second common line cooperate with each other to turn off and on to supply voltages corresponding to the gate electrode driver circuit for the common line, which ensures the voltages on the common line correspond to the voltage of stage one and the voltage of stage two respectively when the gate electrode driver circuit is started. Other elements also may be used to control the turning off or on of the first common voltage line or the second common voltage line.

More specifically, after stage one is completed when the gate electrode driver circuit is started, the method further includes Step M: starting timing by the detection circuit of the display panel, and beginning to execute the next step when the preset time is reached. The preset time can be set to be different according to different display panels, for example, after one frame time (16.7 ms), the first common voltage line is kept off, and the gamma circuit supplies a preset common voltage to the common line through the second common voltage line, so that it is ensured that the voltage on the common line is consistent with the output voltage of the source electrode driver circuit when the display panel is started.

And after stage one is completed, when the detection circuit detects that the first common voltage line is turned on, starting to execute the step of stage two. More specifically, when the detection circuit detects that a current exists at a point P in the first common voltage line, the first common voltage line is in a turning on state, the next step is executed, and when the detection circuit detects that the time reaches a preset time (for example, a frame time), the stage of normal display is started.

In stage two of starting the gate electrode driver circuit, the second common voltage line is turned off, and simultaneously the first common voltage line is turned on, and the voltage identical as the initial voltage output from the source electrode driver circuit is supplied to the common line through the gamma circuit. The initial voltage output by the source electrode driver circuit may also be directly turned on to the common line. The two different ways of supplying the output voltage above correspond to two different circuit connections, but both can realize the regulation and control of the voltage at two ends of the liquid crystal. When voltage is supplied through the gamma circuit, there is no need for other external connecting wires, the voltage is directly and uniformly regulated through the gamma circuit, so that the whole circuit structure is convenient to adjust; when the initial voltage output by the source electrode driver circuit is directly turned on, the output voltage of the source electrode driver circuit in stage two can be ensured to be completely consistent with the voltage on the common line, which ensures the voltage difference between two ends of the liquid crystal to be zero, and effectively avoids flash problems during startup.

Figure 3:
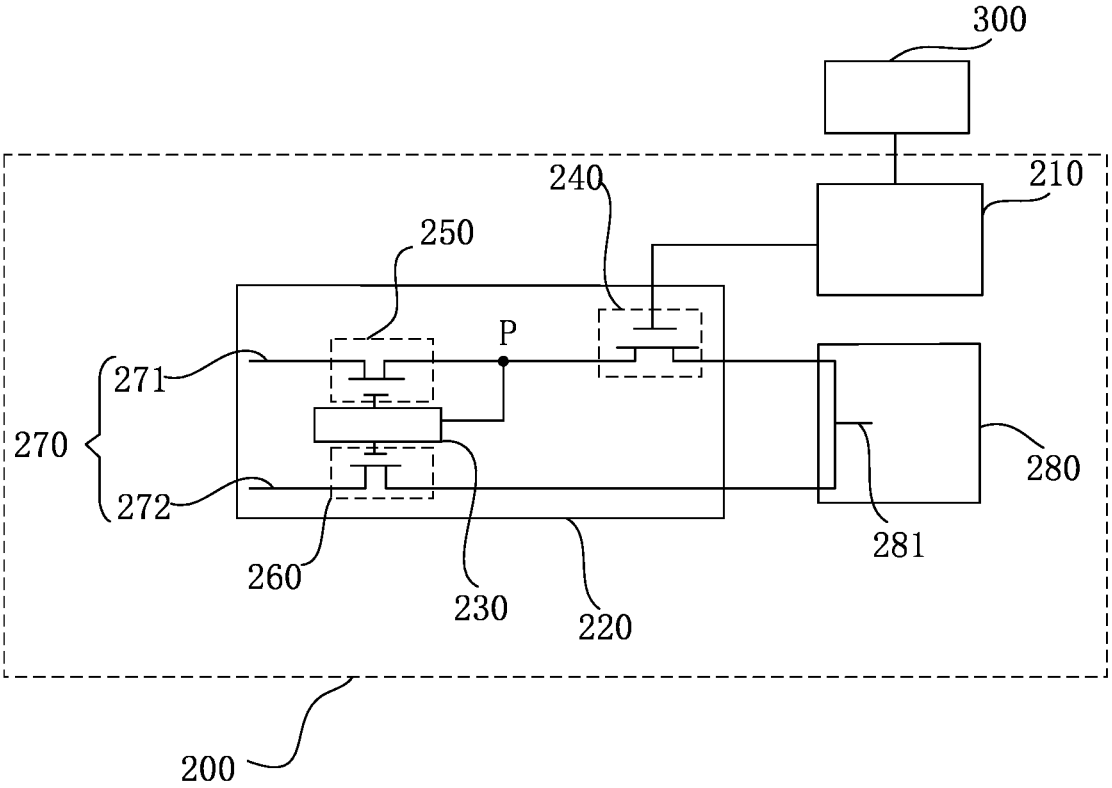
FIG. 3 is a schematic diagram of a driver circuit of a display panel according to another embodiment of the present application.

Referring to FIG. 3, the present application further discloses a driver circuit 200 for a display panel, which includes a source electrode driver circuit 210 configured to supply driving voltage to the display panel, a gamma circuit 220 configured to supply common voltage to the display panel, a first switch 240, a second switch 250 and a third switch 260, and a detection circuit 230 configured to detect the source electrode driver circuit and in control connection with the second switch 250 and the third switch 260. The output terminal of the source electrode driver circuit 210 is in control connection with the control terminal of the first switch 240; the output terminal of the second switch 250 is connected to the input terminal of the first switch 240; the output terminal of the gamma circuit 220 is connected to the input terminal of the second switch 250 and the input terminal of the third switch 260; the detection circuit 230 is in control connection with the control terminals of the second switch 250 and the third switch 260, respectively; the output terminal of the first switch 240 and the output terminal of the third switch 260 are respectively connected to the common line 281 of the display panel. The detection circuit 230 is initialized to control the third switch 260 to be kept on when the detection circuit is started; when the source electrode driver circuit 210 is started and outputs a preset initial voltage, the detection circuit 230 keeps the second switch 250 on, meanwhile keeps the third switch 260 off; after the source electrode driver circuit 210 is started, the timing controller 300 outputs a gray-scale voltage to the source electrode driver circuit 210, and the gray-scale voltage is transmitted to the display panel through the source electrode driver circuit 210 by the detection circuit 230. At the moment, the second switch 250 is controlled to be kept off, meanwhile the third switch 260 is kept on.

When the display panel is started, the source electrode driver circuit 210 starts to enter stage one, the output terminal of the source electrode driver circuit 210 outputs 0 V voltage, meanwhile, the first switch 240 is kept off when the initial low level enters, the detection circuit 230 is initialized to control the second switch 250 to be turned on in stage one, the third switch 260 is turned on, at this time, the first common voltage line 271 is turned off, the second common voltage line 272 is turned on, and the gamma circuit 220 outputs 0 V voltage to the common line 281 through the second common voltage line 272. When the source electrode driver circuit 210 enters stage two, the source electrode driver circuit 210 outputs a preset initial voltage (the same as the initial voltage output by the source electrode driver circuit) as a working voltage (for example, 7 V) and controls the first switch 240 to be turned on, the detection circuit 230 controls the second switch 260 to be turned on, the third switch 260 is turned off, at this time, the first common voltage line 271 is turned on, the second common voltage line 272 is turned off, and the gamma circuit 220 outputs the identical initial voltage to the common line 281 through the first common voltage line 271; after the source driver circuit 210 is started, the detection circuit 230 controls the second switch 250 to be turned off, the third switch 260 is turned on, at this time, the first common voltage line 271 is turned off, the second common voltage line 272 is turned on, and meanwhile the gamma circuit 220 is controlled to output a preset common voltage to the common line 281. The common line 281 is located in the circuit of the substrate 280, where the substrate 280 may be a color filter substrate or an array substrate;

specifically, as shown in FIG. 3, the common voltage line 270 includes a first common voltage line 271 and a second common voltage line 272, the input terminal of the first common voltage line 271 is connected to the gamma circuit 220, the output terminal of the first common voltage line is connected to the common line, and the first switch 240 and the second switch 250 control the first common voltage line 271 to be turned on and off; the input terminal of the second common voltage line 272 is connected to the gamma circuit 220, the output terminal of the second common voltage line is connected to the common line 281, and the third switch 260 controls the second common voltage line 272 to be turned on and off; the source electrode driver circuit 210 of the display panel is started, OV voltage is output, the first switch 240 is kept off, the detection circuit 230 is initialized to control the second switch 250 and the third switch 260 to be kept on when the detection circuit is started, the first common voltage line 271 is turned off, the second common voltage line 272 is turned on, and the gamma circuit 220 outputs OV voltage to the common line 281 through the second common voltage line 272; when voltage is supplied through the gamma circuit 220, there is no need for other external connecting wires, the voltage is directly and uniformly regulated through the gamma circuit 220, so that the whole circuit structure is convenient to adjust.

Figure 4:
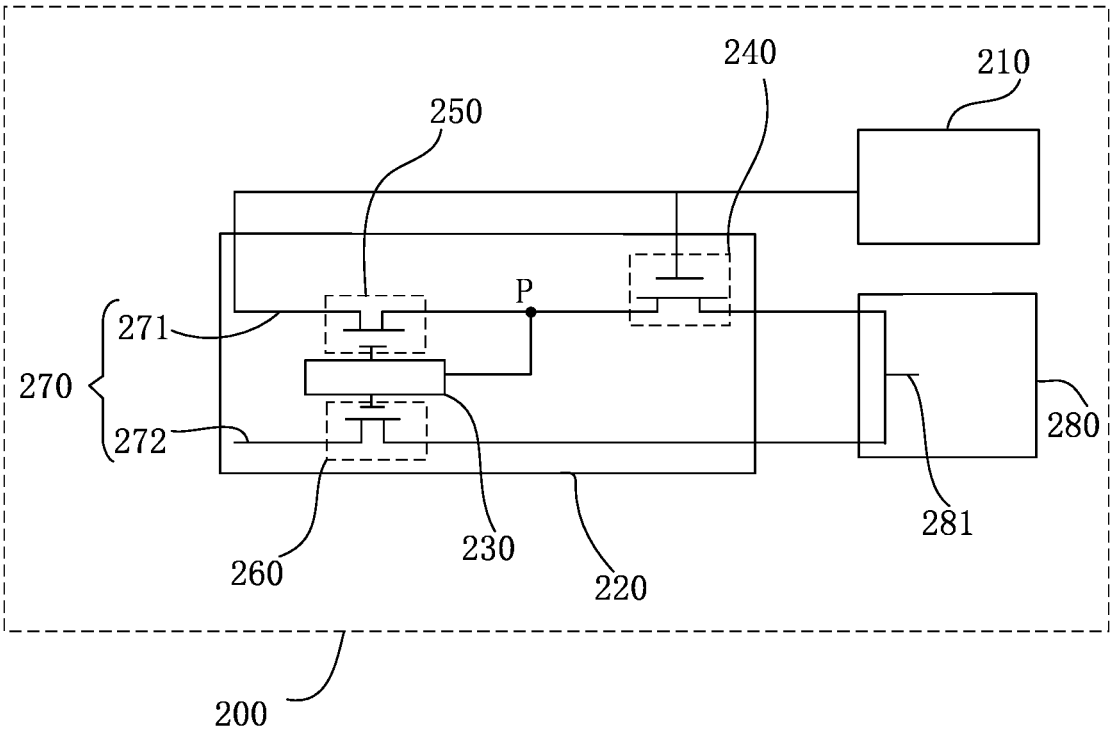
FIG. 4 is a schematic diagram of a driver circuit of a display panel according to another embodiment of the present application.

The initial voltage may also be directly turned on to the common line 281 through the first common voltage line 271 by the source electrode driver circuit 210 in stage two. Referring to FIG. 4, the present application further discloses a driver circuit 200 for a display panel, which includes a source electrode driver circuit 210 configured to supply driving voltage to the display panel, a first switch 240, a second switch 250 and a third switch 260, and a detection circuit 230 configured to detect the source electrode driver circuit 210 and in control connection with the second switch 250 and the third switch 260. The output terminal of the source electrode driver circuit 210 is in control connection with the control terminal of the first switch 240 and the input terminal of the second switch 250; the output terminal of the second switch 250 is connected to the input terminal of the first switch 240; the input terminal of the third switch 260 is connected to the output terminal of the gamma circuit 220; the detection circuit 230 is in control connection with the control terminals of the second switch 250 and the third switch 260, respectively; the output terminal of the first switch 240 and the output terminal of the third switch 260 are respectively connected to the common line 281 of the display panel; the detection circuit 230 is initialized to control the third switch 260 to be kept on when the detection circuit is started; when the source electrode driver circuit 210 is started and outputs a preset initial voltage, the detection circuit 230 keeps the second switch 250 on, meanwhile keeps the third switch 260 off; after the source electrode driver circuit 210 is started, the timing controller 300 outputs a gray-scale voltage to the source electrode driver circuit 210, and the gray-scale voltage is transmitted to the display panel through the source electrode driver circuit 210. At the moment, the second switch 250 is controlled to be kept off, meanwhile the third switch 260 is kept on; when the initial voltage output by the source electrode driver circuit 210 is directly turned on, the output voltage of the source electrode driver circuit 210 in stage two can be ensured to be completely consistent with the voltage on the common line 281, which ensures the voltage difference between two ends of the liquid crystal to be zero, and effectively avoids flash problems during startup.

Unlike the gamma circuit 220 supplying the initial voltage to the common line in stage two, this circuit directly connects the output terminal of the source electrode driver circuit 210 to the input terminal of the second switch 250, and when in stage two, the first switch 240 and the second switch 250 are kept on, the third switch 260 is kept off, and the voltage of the source electrode driver circuit 210 is directly input to the common line 281, thereby ensuring the voltages at the two ends of the liquid crystal are completely consistent.

As shown in FIG. 4, the common voltage line 270 includes a first common voltage line 271 and a second common voltage line 272, the input terminal of the first common voltage line 271 is connected to the gamma circuit 220, the output terminal of the first common voltage line is connected to the common line 281, and the first switch 240 and the second switch 250 control the first common voltage line 271 to be turned on and off; the input terminal of the second common voltage line 272 is connected to the gamma circuit 220, the output terminal of the second common voltage line is connected to the common line 281, and the third switch 260 controls the second common voltage line 272 to be turned on and off; the detection circuit 230 is initialized to control the third switch 260 to be kept on when the detection circuit is started, the first common voltage line 271 is turned off, the second common voltage line 272 is turned on, and the gamma circuit outputs OV voltage to the common line 281 through the second common voltage line 272.

Figure 5:
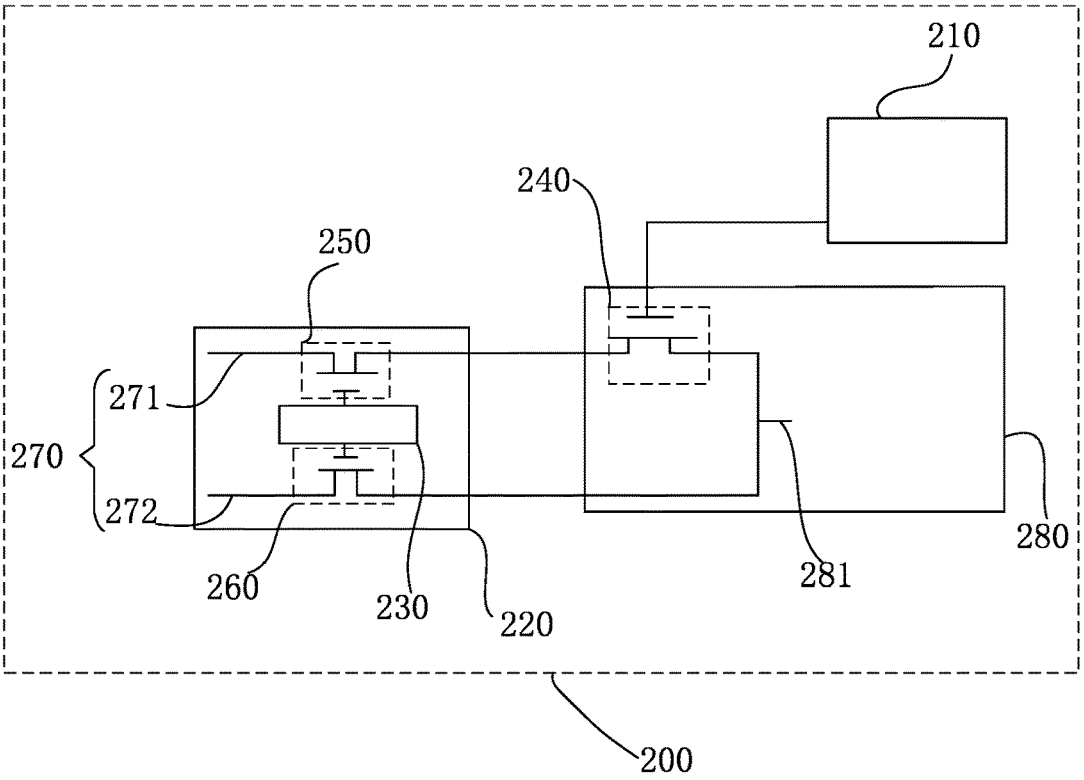
FIG. 5 is a schematic diagram illustrating a first switch being integrated on a substrate according to an embodiment of the present application.
Figure 6:
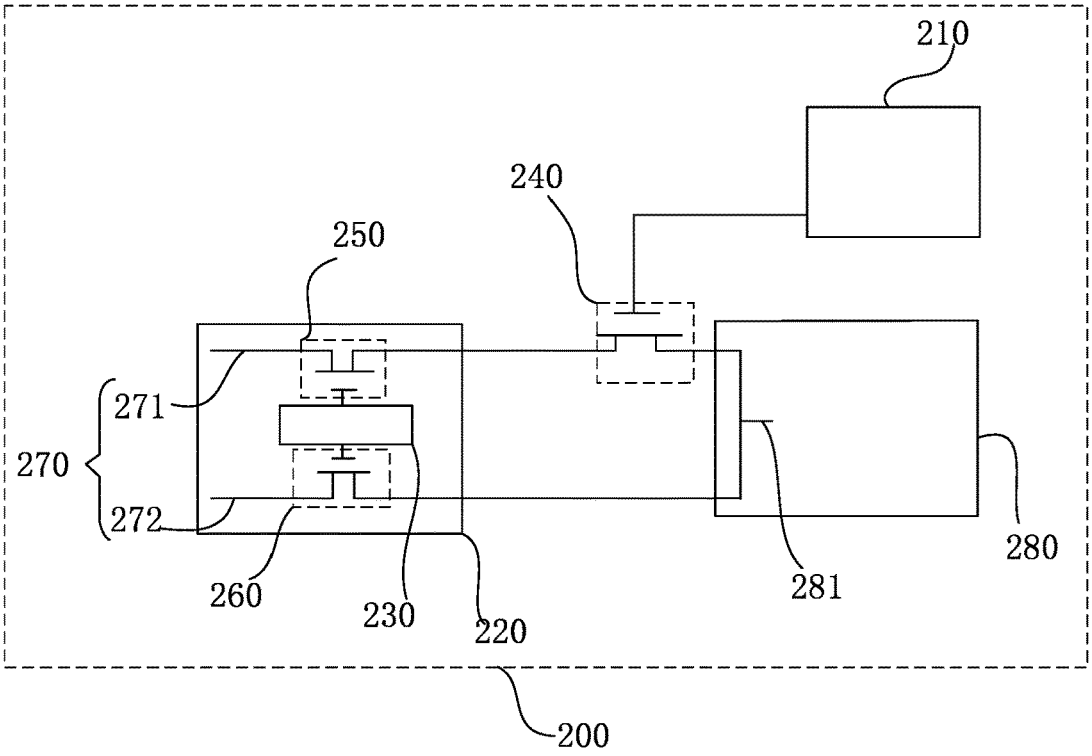
FIG. 6 is a schematic diagram illustrating a first switch being integrated on a driver circuit board according to an embodiment of the present application.

Specifically, the first switch 240 is integrated in the gamma circuit 220, and the first switch 240 is more highly integrated when being designed to be integrated in the gamma circuit 220. Referring to FIGS. 5 and 6, the first switch 240 may also be integrated in the substrate 280 of the display panel or the driver circuit board 110 of the display panel, and designers may adjust the position of the first switch 240 according to their actual requirements.

Figure 7:
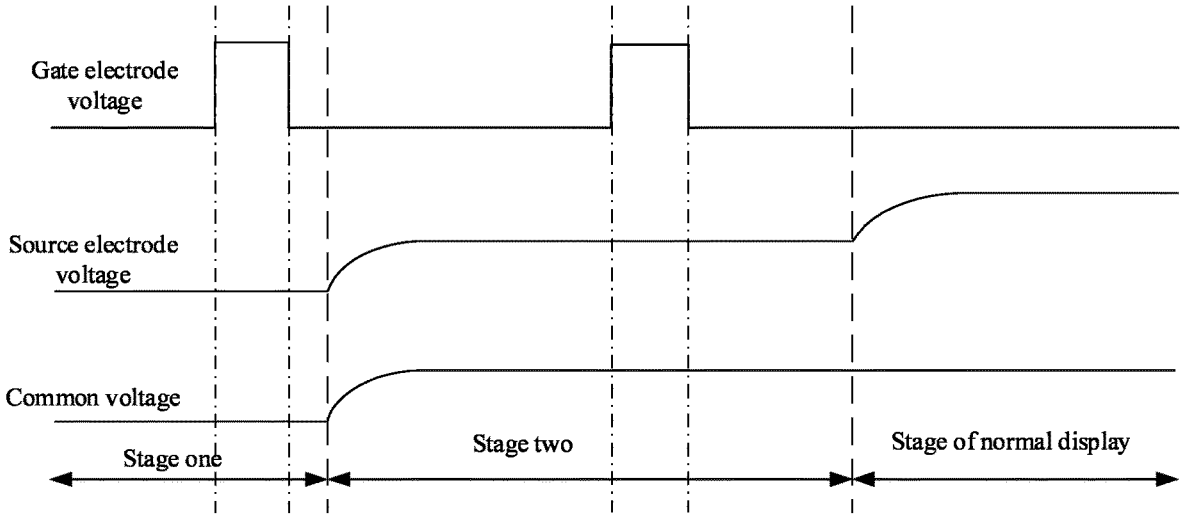
FIG. 7 is a schematic diagram of voltage waveforms according to an embodiment of the present application.

Referring to FIG. 7, after the driver circuit and the driving method of the present application are used, when the display panel (i.e., the gate electrode voltage, i.e., Gout,) is started, in stage one, the source electrode voltage Sout of the source electrode driver circuit and the common voltage Vcom on the common line are both 0 V at this time; in stage two, the source electrode voltage Sout of the source electrode driver circuit and the common voltage Vcom on the common line are both increased similarly, and the voltage difference between the two approaches zero; in the stage of normal display, the source electrode voltage Sout of the source electrode driver circuit is the gray-scale voltage when the display panel is normally displayed, and the common voltage Vcom on the common line is still the preset common voltage.

It should be noted that, the limitation of the steps involved in this solution, without affecting the implementation of the specific solution, is not determined to limit the sequence of steps, and the previous steps may be executed first, later, or even simultaneously, and shall be deemed to fall within the scope of the present application as long as the solution can be implemented.

The technical scheme of the present application can be widely used in various display panels, such as Twisted Nematic (TN) display panels, In-Plane Switching (IPS) display panels, Vertical Alignment (VA) display panels and Multi-Domain Vertical Alignment (MVA) display panels, and, of course, other types of display panels, such as Organic Light-Emitting Diode (OLED) display panels.

The above content is a further detailed description of the present application in conjunction with specific, optional embodiments, and it is not to be construed that specific embodiments of the present application are limited to these descriptions. For those of ordinary skill in the art to which this application belongs, a number of simple derivations or substitutions may be made without departing from the spirit of this application, all of which shall be deemed to fall within the scope of this application.

What is claimed is:

1. A driving method for a display panel comprising steps of:

starting the display panel;

starting a source electrode driver circuit of the display panel, outputting OV voltage, and simultaneously enabling a common line of the display panel to output 0 V voltage or be disconnected;

outputting a preset initial voltage by the source electrode driver circuit of the display panel, and simultaneously enabling the common line of the display panel to output the identical initial voltage; and after starting the source electrode driver circuit of the display panel, transmitting a gray-scale voltage to the display panel; meanwhile, controlling a gamma circuit of the display panel to output a preset common voltage to the common line through a common voltage line;

wherein the common voltage line comprises a first common voltage line and a second common voltage line that are controlled separately;

wherein the step of starting a source electrode driver circuit of the display panel, outputting OV voltage, and simultaneously enabling a common line of the display panel to output 0 V voltage or be disconnected comprises:

turning off the first common voltage line, and turning on the second common voltage line, to enable the common line of the display panel to output 0 V voltage or be disconnected;

the step of outputting a preset initial voltage by the source electrode driver circuit of the display panel, and simultaneously enabling the common line of the display panel to output the identical initial voltage comprises:

turning off the second common voltage line, and simultaneously turning on the first common voltage line, to enable the common line of the display panel to output the identical initial voltage;

the step of after starting the source electrode driver circuit of the display panel, transmitting a gray-scale voltage to the display panel; meanwhile, controlling a gamma circuit to output a preset common voltage to the common line through a common voltage line comprises:

turning off the first common voltage line, and turning on the second common voltage line, to enable the common line of the display panel to output a preset common voltage.

2. The driving method according to claim 1, wherein the step of outputting a preset initial voltage by the source electrode driver circuit of the display panel, and simultaneously enabling the common line of the display panel to output the identical initial voltage comprises:

turning off the second common voltage line, and simultaneously turning on the first common voltage line, and supplying the identical voltage as the initial voltage output from the source electrode driver circuit to the common line through the gamma circuit.

3. The driving method according to claim 1, wherein the step of outputting a preset initial voltage by the source electrode driver circuit of the display panel, and simultaneously enabling the common line of the display panel to output the identical initial voltage comprises:

turning off the second common voltage line, and simultaneously turning on the first common voltage line, and directly turning on the initial voltage output by the source electrode driver circuit to the common line.

4. The driving method according to claim 1, wherein after the step of starting a source electrode driver circuit of the display panel, outputting OV voltage, and simultaneously enabling a common line of the display panel to output 0 V voltage or be disconnected, the method further comprises:

starting to perform the step of after starting the source electrode driver circuit of the display panel, transmitting a gray-scale voltage to the display panel; meanwhile, controlling a gamma circuit of the display panel to output a preset common voltage to the common line through a common voltage line, when a detection circuit of the display panel starts timing and a preset time is reached.

5. The driving method according to claim 1, wherein after the step of starting a source electrode driver circuit of the display panel, outputting OV voltage, and simultaneously enabling a common line of the display panel to output 0 V voltage or be disconnected, starting to perform the step of outputting a preset initial voltage by the source electrode driver circuit of the display panel, and simultaneously enabling the common line of the display panel to output the identical initial voltage only when a detection circuit of the display panel detects that the first common voltage line is turned on.

6. The driving method according to claim 2, wherein the step of starting a source electrode driver circuit of the display panel, outputting OV voltage, and simultaneously enabling a common line of the display panel to output 0 V voltage or be disconnected comprises:

controlling a first switch connected to the first common voltage line to be kept off, and controlling a third switch connected to the second common voltage line to be kept on, to enable the common line of the display panel to output 0 V voltage;

the step of outputting a preset initial voltage by the source electrode driver circuit of the display panel, and simultaneously enabling the common line of the display panel to output the identical initial voltage comprises:

controlling a first switch and a second switch connected to the first common voltage line to be kept on, controlling a third switch connected to the second common voltage line to be kept off, and supplying the identical voltage as the initial voltage output from the source electrode driver circuit to the common line through the gamma circuit;

the step of after starting the source electrode driver circuit of the display panel, transmitting a gray-scale voltage to the display panel; meanwhile, controlling a gamma circuit to output a preset common voltage to the common line through a common voltage line comprises:

controlling the second switch connected to the first common voltage line to be kept off, and controlling the third switch connected to the second common voltage line to be kept on, to enable the common line of the display panel to output a preset common voltage.

7. The driving method according to claim 3, wherein, the step of starting a source electrode driver circuit of the display panel, outputting OV voltage, and simultaneously enabling a common line of the display panel to output 0 V voltage or be disconnected comprises:

controlling a first switch connected to the first common voltage line to be kept off, and controlling a third switch connected to the second common voltage line to be kept on, to enable the common line of the display panel to output 0 V voltage;

the step of outputting a preset initial voltage by the source electrode driver circuit of the display panel, and simultaneously enabling the common line of the display panel to output the identical initial voltage comprises:

controlling a first switch and a second switch connected to the first common voltage line to be turned on, controlling a third switch connected to the second common voltage line to be turned off, and directly turning on the initial voltage output from the source electrode driver circuit to the common line;

the step of after starting the source electrode driver circuit of the display panel, transmitting a gray-scale voltage to the display panel; meanwhile, controlling a gamma circuit to output a preset common voltage to the common line through a common voltage line comprises:

controlling the second switch connected to the first common voltage line to be kept off, and controlling the third switch connected to the second common voltage line to be kept on, to enable the common line of the display panel to output a preset common voltage.

8. The driving method according to claim 4, wherein the preset time is set to one frame time.

9. A driver circuit for a display panel, comprising:

a source electrode driver circuit configured to supply driving voltage for the display panel;

a gamma circuit configured to supply a common voltage to the display panel;

a first switch, a second switch, and a third switch;

a common voltage line through which the gamma circuit outputs a preset common voltage to the common line; and a detection circuit configured to detect the source electrode driver circuit and be in control connection with the second switch and the third switch;

wherein the output terminal of the source electrode driver circuit is in control connection with the control terminal of the first switch; the output terminal of the second switch is connected to the input terminal of the first switch; the output terminal of the gamma circuit is connected to the input terminal of the second switch and the input terminal of the third switch;

the detection circuit is in control connection with the control terminals of the second switch and the third switch, respectively;

the output terminal of the first switch and the output terminal of the third switch are respectively connected to the common line of the display panel;

the source electrode driver circuit of the display panel is started, OV voltage is output, the first switch is kept off, the detection circuit is initialized to control the second switch and the third switch to be kept on when the detection circuit is started, and the gamma circuit outputs OV voltage to the common line through the common voltage line;

when the source electrode driver circuit is started and outputs a preset initial voltage, the detection circuit turns on the first switch, keeps the second switch on, and meanwhile keeps the third switch off, and outputs the identical voltage as the initial voltage to the common line;

and when the source electrode driver circuit finishes starting and outputs a gray-scale voltage, the detection circuit controls the second switch to be kept off, meanwhile keeps the third switch on, and the gamma circuit outputs a preset common voltage to the common line.

10. The driver circuit according to claim 9, wherein the common voltage line comprises a first common voltage line and a second common voltage line;

the input terminal of the first common voltage line is connected to the gamma circuit, the output terminal of the first common voltage line is connected to the common line, and the first switch and the second switch control the first common voltage line to be turned on and off; the input terminal of the second common voltage line is connected to the gamma circuit, the output terminal of the second common voltage line is connected to the common line, and the third switch controls the second common voltage line to be turned on and off;

the source electrode driver circuit of the display panel is started, OV voltage is output, the first switch is kept off, the detection circuit is initialized to control the second switch and the third switch to be kept on when the detection circuit is started, the first common voltage line is turned off, the second common voltage line is turned on, and the gamma circuit outputs OV voltage to the common line through the second common voltage line.

11. The driver circuit according to claim 10, wherein when the source electrode driver circuit is started and outputs a preset initial voltage, the detection circuit turns on the first switch, keeps the second switch on, meanwhile keeps the third switch off, and supplies the identical voltage as the initial voltage output from the source electrode driver circuit through the gamma circuit to the common line through the first common voltage line.

12. The driver circuit according to claim 9, wherein the common line is disposed in a substrate of the display panel, and the substrate comprises a color filter substrate or an array substrate.

13. The driver circuit according to claim 9, wherein the first switch is integrated in the gamma circuit.

14. The driver circuit according to claim 9, wherein the first switch is integrated in the substrate of the display panel.

15. A driver circuit for a display panel, comprising:

a source electrode driver circuit configured to supply driving voltage for the display panel;

a gamma circuit configured to supply a common voltage to the display panel;

a first switch, a second switch, and a third switch;

a common voltage line through which the gamma circuit outputs a preset common voltage to the common line; and a detection circuit configured to detect the source electrode driver circuit and be in control connection with the second switch and the third switch;

wherein the output terminal of the source electrode driver circuit is in control connection with the control terminal of the first switch and the input terminal of the second switch; the output terminal of the second switch is connected to the input terminal of the first switch; the input terminal of the third switch is connected to the output terminal of the gamma circuit;

the detection circuit is in control connection with the control terminals of the second switch and the third switch, respectively;

the output terminal of the first switch and the output terminal of the third switch are respectively connected to the common line of the display panel;

the detection circuit is initialized to control the third switch to be kept on when the detection circuit is started, and the gamma circuit outputs OV voltage to the common line through the common voltage line; when the source electrode driver circuit is started and outputs a preset initial voltage, the detection circuit keeps the second switch on, meanwhile keeps the third switch off, and turns on the initial voltage to the common line; and when the source electrode driver circuit finishes starting and outputs a gray-scale voltage, the detection circuit controls the second switch to be kept off, meanwhile keeps the third switch on.

16. The driver circuit according to claim 15, wherein the common voltage line comprises a first common voltage line and a second common voltage line;

the input terminal of the first common voltage line is connected to the gamma circuit, the output terminal of the first common voltage line is connected to the common line, and the first switch and the second switch control the first common voltage line to be turned on and off; the input terminal of the second common voltage line is connected to the gamma circuit, the output terminal of the second common voltage line is connected to the common line, and the third switch controls the second common voltage line to be turned on and off;

the detection circuit is initialized to control the third switch to be kept on when the detection circuit is started, the first common voltage line is turned off, the second common voltage line is turned on, and the gamma circuit outputs OV voltage to the common line through the second common voltage line.

17. The driver circuit according to claim 16, wherein when the source electrode driver circuit is started and outputs a preset initial voltage, the detection circuit keeps the second switch on, and the source electrode driver circuit turns on the initial voltage to the common line through the first common voltage line.

18. The driver circuit according to claim 14, wherein the first switch is integrated in the driver circuit of the display panel.

* * * * *